US005950598A

United States Patent [19]

Wenzlawski et al.

[11] Patent Number: 5,950,598

[45] Date of Patent: Sep. 14, 1999

[54] METHOD FOR DETERMINING THE INJECTION TIME FOR A DIRECT-INJECTION INTERNAL COMBUSTION ENGINE

[75] Inventors: Klaus Wenzlawski, Nürnberg; Arno Friedrich, Regensburg, both of Germany

[73] Assignee: Siemens Aktiengesellschaft, Muenchen, Germany

[21] Appl. No.: 09/069,455

[22] Filed: Apr. 29, 1998

[30] Foreign Application Priority Data

Apr. 29, 1997 [DE] Germany ..... 197 18 171

[51] Int. Cl.[6] ..... F02M 7/00

[52] U.S. Cl. ..... 123/435; 123/486

[58] Field of Search ..... 123/435, 486

[56] References Cited

U.S. PATENT DOCUMENTS

| | | | |
|---|---|---|---|
| 4,397,285 | 8/1983 | O'Neill . | |
| 4,449,501 | 5/1984 | Greeves | 123/435 |
| 4,736,724 | 4/1988 | Hamburg et al. | 123/435 |
| 5,222,481 | 6/1993 | Morikawa et al. | 123/435 |
| 5,313,920 | 5/1994 | Matsushita | 123/435 |
| 5,313,924 | 5/1994 | Regueiro . | |
| 5,718,203 | 2/1998 | Shimada et al. | 123/435 |

*Primary Examiner*—Erick R. Solis
*Attorney, Agent, or Firm*—Herbert L. Lerner; Laurence A. Greenberg

[57] ABSTRACT

Exact metering of the fuel to be injected into the cylinder of an internal combustion engine takes into account the pressure in a high-pressure common rail, the required injection mass of fuel, and a compression prevailing in the respective cylinder at an injection onset.

2 Claims, 2 Drawing Sheets

METHOD FOR DETERMINING THE INJECTION TIME FOR A DIRECT-INJECTION INTERNAL COMBUSTION ENGINE

BACKGROUND OF THE INVENTION

Field of the Invention

The invention relates to a method for determining the injection time for a direct-injection internal combustion engine wherein a high-pressure reservoir is provided from which fuel is delivered to an injector, and an injection time for the injector is ascertained in dependence on a value for a required injection mass of fuel and of the pressure in the high-pressure reservoir.

Internal combustion engines with direct injection are very promising with regard to reducing fuel consumption with relatively low pollutant emissions. In contrast to intake pipe injection, in direct injection fuel is injected at high pressure directly into the combustion chamber.

Injection systems with a central pressure reservoir (common rail) are known in the prior art. In those so-called common rail systems, a fuel pressure regulated by an electronic control unit of the engine, via pressure sensors and pressure regulators, is built up in the common rail and is available largely independently of the engine speed (rpm) and the injection quantity. The fuel is injected into the combustion chamber via an electrically driven injector. The injector receives its signals from the control unit.

By functionally separating the pressure generation and the injection, the injection pressure can be selected largely freely, regardless of the current operating point of the engine.

Modern electronically controlled injection systems for diesel engines are time-controlled, as compared with the old mechanically controlled systems. In the latter, the reference point is the compressed volume and they moreover have a fixed relationship between the feed rate and the engine speed, and hence a fixed relationship between the injection pressure and the speed. This means that in conventional systems, with the same adjustment of the quantity adjusting mechanism, the same fuel volume is always injected regardless of the ambient conditions prevailing at the time. By comparison, in time- controlled systems, a triggering time must be ascertained on the basis of a calculated injection mass.

In common rail systems, in which the injection pressure can accordingly be adjusted independently of the operating point of the engine, the injector triggering time required for a particular injection mass is dependent, under constant ambient conditions, on the pressure drop prevailing just at that time at the injector, i.e. the injection nozzle.

In the control unit, the requisite triggering time is ascertained from a characteristic map, which is plotted for the required injection mass and the current pressure in the pressure reservoir (common rail). The basis for the map are measurements made on a test bench, in which the rail pressure and the triggering time are varied, and the injection masses resulting from the variation are measured. The injectors then inject counter to the ambient pressure. When the data obtained in this way are entered into a memory of the electronic control unit, injection events that are incorrect in terms of the injection mass can occur during engine operation, as a consequence of prevailing pressure conditions at the injection nozzle that differ from those on the test bench.

SUMMARY OF THE INVENTION

It is accordingly an object of the invention to provide a method for determining the injection time in a direct-injecting internal combustion engine, which overcomes the above-mentioned disadvantages of the prior art devices and methods of this general type and which permits the most accurate possible metering of the required injection mass. With the foregoing and other objects in view there is provided, in accordance with the invention, a method of determining an injection time in an internal combustion engine with direct injection, the method which comprises:

delivering fuel from a high-pressure reservoir to an injector;

determining an injection time for the injector in dependence on a value for a required injection mass of fuel into the respective cylinder, a pressure in the high-pressure reservoir, and a compression prevailing in the respective cylinder at an injection onset.

By taking the pressure in the cylinder into account in determining the injector triggering time, it becomes possible in a simple way to meter the required injection mass with great accuracy.

In accordance with an added feature of the invention, the injection time is ascertained as a function of the injection mass and the pressure in the high-pressure reservoir by multiplying the injection time by a time lengthening factor.

In accordance with an additional feature of the invention, the time lengthening factor is determined as a function of the pressure in the high-pressure reservoir and the compression in the cylinder, wherein the time lengthening factor is greater the smaller a pressure difference at the injector.

In accordance with another feature of the invention, the determining step comprises ascertaining the time lengthening factor ascertained by the following equation:

$$f = \sqrt{\frac{(p_{rail} - 1)}{(p_{rail} - p_{cyl})}},$$

where $p_{rail}$ is the pressure in the high-pressure reservoir and $p_{cyl}$ is the compression in the respective cylinder.

In accordance with a concomitant feature of the invention, a pressure difference between the pressure in the high-pressure reservoir and the compression in the cylinder, together with the required injection mass, are used as input variables for an injection map, wherein the injection time for the injector is stored in the injection map as a function of the pressure difference and the required injection mass.

Other features which are considered as characteristic for the invention are set forth in the appended claims.

Although the invention is illustrated and described herein as embodied in a method for determining the injection time for a direct-injection internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
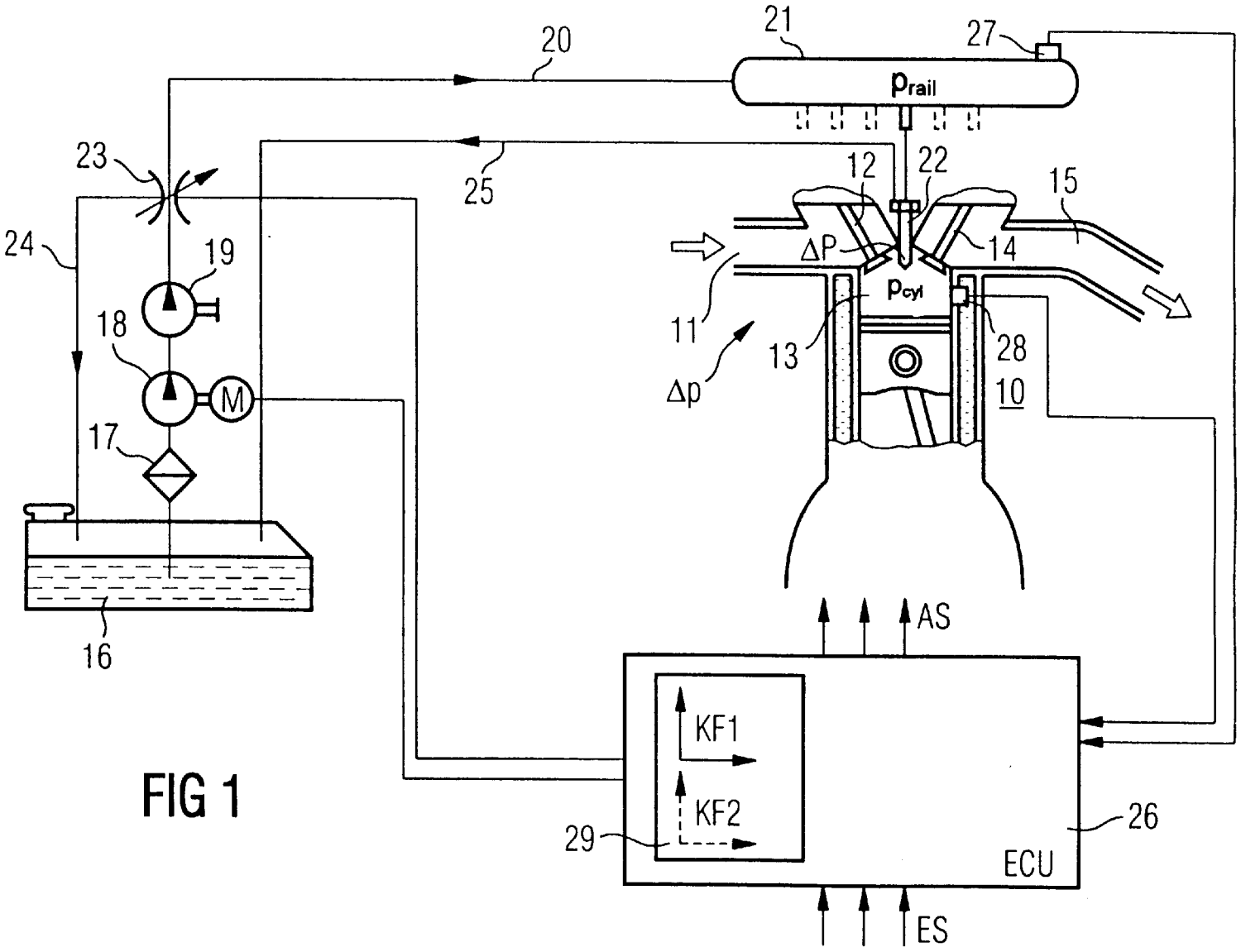
FIG. 1 is a schematic block diagram of a direct-injection internal combustion engine with a high-pressure reservoir and an associated control unit.

Referring now to the figures of the drawing in detail and first, particularly, to FIG. 1 thereof, there is seen a block diagram which illustrates the technical field to which the invention pertains. Only those parts which are necessary for comprehension of the invention are shown. A diesel engine 10 is supplied with the requisite air for combustion via an intake line 11 and an inlet valve 12. A piston and the inner walls of the cylinder define a combustion chamber 13. The exhaust gas flows via an outlet valve 14 into an exhaust gas duct 15.

The injection system has a fuel tank 16, which communicates via a fuel filter 17 and a prefeed pump 18 with a high-pressure pump 19, which pumps fuel at high pressure into a high-pressure line 20. The high-pressure line 20 is connected to an injection rail 21, which has injectors 22 in the form of injection nozzles. The nozzles inject fuel into the combustion chambers of the engine. The injection rail 21, in the preferred embodiment, is a high-pressure reservoir (common rail).

The high-pressure line 20 has a driven pressure control element 23, which by way of example is a regulatable pump or a pressure regulating valve, and which communicates with the fuel take 16 via a bleed line 24. The injector 22 are connected to a second bleed line 25, which also leads to the fuel tank 16. The pressure control element 23 communicates with an electronic control unit ECU via a trigger line, not identified by reference numeral. The prefeed pump 18 communicates with the electronic control unit in the same way. The high-pressure pump 19 can be driven by the engine itself, for instance by the crankshaft, or electrically. The control unit 26 also communicates with a pressure sensor 27, which is disposed on the injection rail 21 and which detects the fuel pressure $p_{rail}$ in the injection strip 21 and thus in the high-pressure region. A pressure sensor 28 detects the pressure in the combustion chamber 13 and outputs a signal to the control unit that represents the cylinder pressure $P_{cyl}$, and in particular the compression. The control unit 26 also has access to a memory 29, in which among other things an injection map KF1 and/or KF2 is stored. It also has other, generally designated inputs ES, by way of which data of the engine that are required for its operation, such as the load or speed, are delivered. Other output variables of the control unit for triggering various actuators are identified by the symbol AS.

The general function of this kind of direct-injection system with a high-pressure reservoir is known and will therefore not be described in detail here. It will be explained below how the injection time can be corrected in order to inject the required injection mass into the combustion chamber.

A first possibility is to ascertain a factor with which the value for the requisite triggering time for the injector, read out from the injection map KF1 as a function of the required injection mass and the current pressure in the pressure reservoir $p_{rail}$, is varied.

The pressure drop Δp at the injector 22 can be calculated by the equation $$\Delta p = p_{rail} = p_{cyl}$$

where $p_{rail}$ is the pressure in the pressure reservoir and $p_{cyl}$ is the pressure in the combustion chamber.

The pressure drop is taken into account in calculating the triggering time. To that end, a factor with which the injection time, read out from the injection map KF1, is corrected is calculated.

The mass flow through a throttle restriction, in which case the nozzle opening of the injector, is calculated by the equation $$\dot{m} = \mu * A * \sqrt{\frac{2\Delta p}{\rho}} * \rho$$

where $\mu$=throughput coefficient;

A=effective cross-sectional area of the nozzle opening;

ρ=fuel density;

Δ=pressure drop.

The mass flow $\dot{m}_{testbench}$ measured at the test bench with a counterpressure of $p_{ambient}$=1 (standardized value) then, with the pressure drop $\Delta p - p_{rail} - p_{ambient}$ prevailing there, becomes:

$$\dot{m}_{testbench} = \mu * A * \sqrt{\frac{2(p_{rail} - p_{ambient})}{\rho}} * \rho$$

or $$\dot{m}_{testbench} = \mu * A * \sqrt{\rho \frac{2(p_{rail} - 1)}{\rho}} * \rho$$

In the engine in which the fuel from the high-pressure reservoir is injected not against ambient pressure but rather into the combustion chamber at counterpressure $p_{cyl}$, the following mass flow $\dot{m}_{testbench}$ is established, with the same triggering time and the same rail pressure $p_{rail}$ as in the test bench measurement, as follows:

$$\dot{m}_{ICE} = \mu * A * \sqrt{\frac{2(p_{rail}) - p_{cyl}}{\rho}} * \rho$$

If the two mass flows $\dot{m}_{testbench}$ and $\dot{m}_{ICE}$ are set into relation with one another, the result is a dimensionless time lengthening factor f:

$$f = \sqrt{\frac{\dot{m}_{testbench}}{\dot{m}_{ICE}}} = \sqrt{\frac{(p_{rail} - 1)}{(p_{rail} - p_{cyl})}},$$

with which the injection time trap, stored in the injection map KF1 and read out for controlling the injection event, is acted upon in accordance with the following equation:

$$t = t_{map} * f,$$

where t is the corrected injection time.

Figure 2:
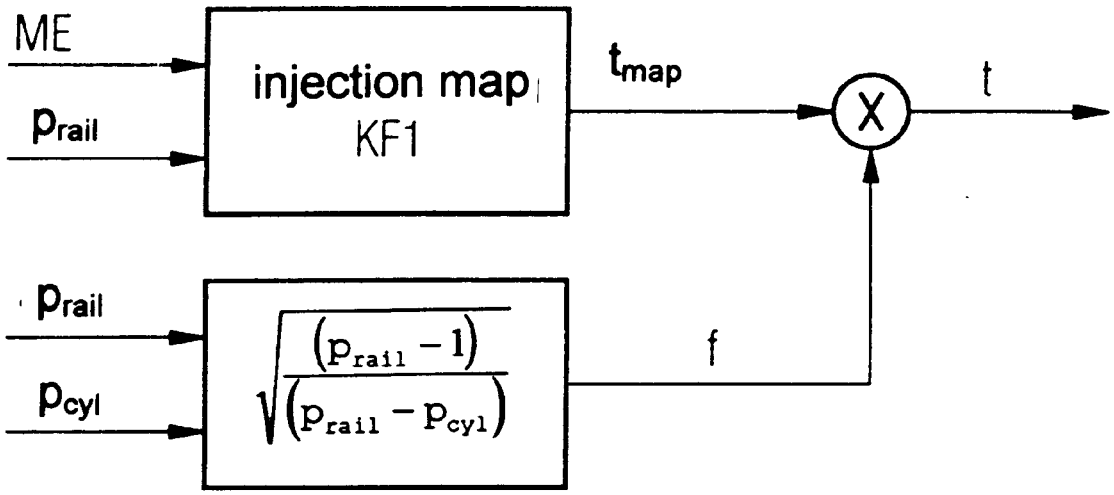
FIG. 2 is a schematic diagram concerning a system for ascertaining the injection time.

In FIG. 2, the procedure of calculating the corrected injection time is shown in the form of a block circuit diagram. As noted at the outset, the values for the injection time $t_{map}$ that were ascertained on the test bench are stored in the injection map KF1 as a function of the injection mass ME and the pressure in the pressure reservoir $p_{rail}$. The values for the current pressure in the pressure reservoir $p_{rail}$ and for the pressure in the combustion chamber $p_{cyl}$ are ascertained with respective pressure sensors 27 and 28.

As an alternative, the pressure in the combustion chamber can also be ascertained from the maximum value for the compression, or via a characteristic curve that represents the course of the compression over the crankshaft angle.

Figure 3:
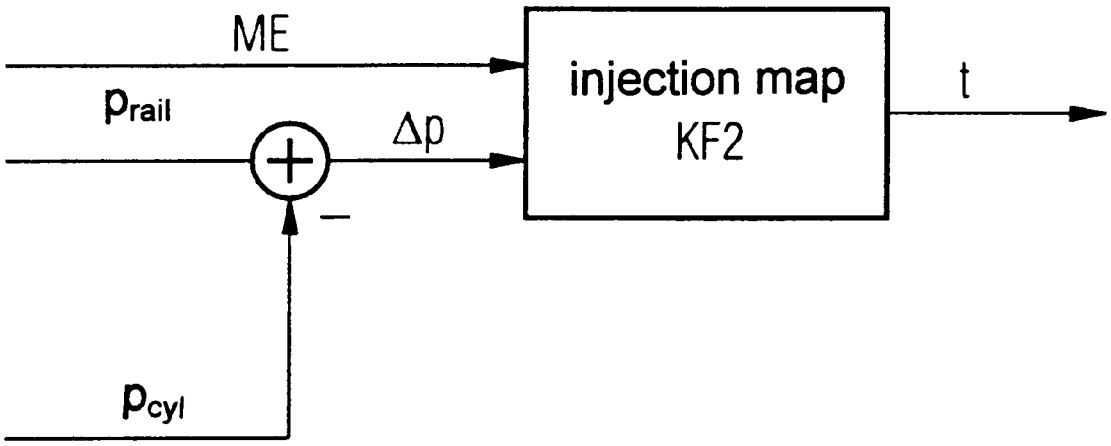
FIG. 3 is a schematic diagram of an alternative embodiment.

FIG. 3 shows another possible way to take the pressure in the combustion chamber into account in determining the injection time. Here it is not the pressure $p_{rail}$ in the high-pressure reservoir that is used as an input variable of the injection map KF2, but rather the actual difference $\Delta p$, between the rail pressure $p_{rail}$ and the cylinder pressure $p_{cyl}$, that prevails at the nozzle of the injector. Thus with the same pressure difference and the same triggering time, the same injection mass can be attained in the engine as on the test bench.

The method according to the invention has been explained in terms of a direct-injection diesel engine with a high-pressure reservoir. However, the invention is equally well suited to an Otto engine operating with high-pressure injection and a common rail, in which the pressure difference at the injection valve is to be taken into account in determining the injection time.

The cylinder compression $p_{cyl}$ may be determined, for example, by a process as it is described in applicants' copending application Serial No. (Atty. Docket GR 97 P 1544, German application DE 197 18 172.4), which is herewith incorporated by reference.

We claim:

1. A method of determining an injection time in an internal combustion engine with direct injection, the method which comprises:

delivering fuel from a high-pressure reservoir to an injector;

determining an injection time for the injector in dependence on a value for a required injection mass of fuel into the respective cylinder, a pressure in the high-pressure reservoir, and a compression prevailing in the respective cylinder at an injection onset by correcting the injection time ascertained as a function of the injection mass and the pressure in the high-pressure reservoir by multiplying the injection time by a time lengthening factor f ascertained by the following equation:

$$f = \sqrt{\frac{(p_{rail} - 1)}{(p_{rail} - p_{cyl})}},$$

where $p_{rail}$ is the pressure in the high-pressure reservoir and $p_{cyl}$ is the compression in the respective cylinder.

2. A method of determining an injection time in an internal combustion engine with direct injection, the method which comprises:

delivering fuel from a high-pressure reservoir to an injector;

determining a pressure in the high pressure reservoir by means of a pressure sensor;

determining a compression prevailing in a respective cylinder of an internal combustion engine at an injection onset;

providing a pressure difference between the pressure in the high pressure reservoir and the compression prevailing at the respective cylinder and providing a value for a required injection mass of the fuel into the respective cylinder as input variables for an injection map stored in a memory of a control device of the internal combustion engine; and reading out a value for an injection time for the injector from the injection map corresponding to the input variables.

* * * * *